US007214118B1

(12) United States Patent
Maxim

(10) Patent No.: US 7,214,118 B1
(45) Date of Patent: May 8, 2007

(54) ROTATABLE DISK ILLUMINATED PICTURE BOARD WITH DISK OFFSET ENGAGING AND ORIENTING STRUCTURES

(76) Inventor: John G. Maxim, 836 Coventry St., Boca Raton, FL (US) 33487

( * ) Notice: Subject to any disclaimer, the term of this patent is extended or adjusted under 35 U.S.C. 154(b) by 0 days.

(21) Appl. No.: 10/255,985

(22) Filed: Sep. 26, 2002

(51) Int. Cl.
*A63H 33/06* (2006.01)
*A63H 33/22* (2006.01)
*F21S 13/14* (2006.01)
*G09F 13/00* (2006.01)

(52) U.S. Cl. ..... 446/118; 446/219; 362/252; 40/548

(58) Field of Classification Search ..... 446/118, 446/219, 485; 362/252, 255, 456, 231; 273/237, 273/282.1; 434/428, 81, 96; 40/579, 548, 40/550, 451, 452, 547
See application file for complete search history.

(56) References Cited

U.S. PATENT DOCUMENTS 3,530,615 A * 9/1970 Meyer ..... 446/91
3,568,357 A * 3/1971 Lebensfeld ..... 446/91
3,651,246 A * 3/1972 Bergero ..... 358/500
4,196,539 A * 4/1980 Speers ..... 446/75
4,498,674 A * 2/1985 Ferris et al. ..... 273/243
4,891,030 A * 1/1990 Gertzfeld ..... 446/118
5,391,105 A * 2/1995 Jones ..... 446/219
5,644,860 A * 7/1997 Piper et al. ..... 40/579
6,032,393 A * 3/2000 Maxim ..... 40/548
6,238,261 B1 * 5/2001 Lang ..... 446/219

* cited by examiner

*Primary Examiner*—Faye Francis
(74) *Attorney, Agent, or Firm*—Oltman, Flynn & Kubler

(57) ABSTRACT

An image generating apparatus includes an image display board having an array of member ports; a light source behind the display board; a translucent pigment sheet positioned between the image display board and the light source, the translucent pigment sheet including several pigment clusters, each pigment cluster including an array of translucent pigment areas, each member port in the image display board being rotatably fitted with a colorless translucent member preferably in the form of a translucent disk having a disk distal end which is substantially planar and positioned directly proximally of one of the pigment clusters. Each disk has a radially offset selective color admission structure admitting only certain selected wavelengths of light from the light source, each disk having a disk proximal end with a radially offset engaging and orienting structure in the form of a proximally protruding structure or an abrasive surface.

24 Claims, 6 Drawing Sheets

ROTATABLE DISK ILLUMINATED PICTURE BOARD WITH DISK OFFSET ENGAGING AND ORIENTING STRUCTURES

BACKGROUND OF THE INVENTION

1. Field of the Invention

The present invention relates generally to the field of personal entertainment devices including toys. More specifically the present invention relates to an image generating apparatus including an image display board having an array of member ports; a light source behind the display board; a translucent pigment sheet positioned between the image display board and the light source, the translucent pigment sheet including several pigment clusters, each pigment cluster including an array of translucent pigment areas, each member port in the image display board being rotatably fitted with a colorless translucent member preferably in the form of a translucent disk having a disk distal end which is substantially planar and positioned directly proximally of one of the pigment clusters. Each disk has a radially offset selective color admission means admitting only certain selected wavelengths of light from the light source illuminating the disk with corresponding colors from only rotationally selected pigment areas of a pigment cluster, each disk having a disk proximal end with a radially offset engaging and orienting structure in the form of a proximally protruding structure or an abrasive surface. A directing object surface, such as the palm of a user hand, slides over the disk proximal ends and engages the engaging and orienting structures and thereby drags the disks rotationally about their rotational axes to the direction of object movement.

As a result of this construction, light shining from the light source through the pigment sheet causes a selected color or colors to pass into each given disk, so that the disk glows the selected color or colors when seen from the proximal side of the image display board. Rotating any given disk selects different wavelengths of visible light filtered through and isolated by the array of pigment areas in the pigment cluster to illuminate the disk with any of several available colors. By selecting different colors to illuminate the various disks in the display board, an illuminated color pattern or a picture of something may be created.

2. Description of the Prior Art

There have long been board games in which various patterns are created from illuminated elements. In most cases, these have taken the form of tinted and polarized sheet portions which are positioned one over the other to create desired patterns. A problem with these prior devices has been that in some instances the illumination elements have to be removed and thereby subjected to the possibility of loss to change the color or pattern. Another problem has been that the range of color choices for elements, whether mounted individually or overlaid with other elements, has been highly limited. Yet another problem has been that the board cannot be set vertically upright for display without loss of the constructed image.

It is thus an object of the present invention to provide an image creating apparatus having lighted translucent members preferably taking the form of rotatable disks or rods capable of illumination in individually selected colors to combine to form an image such as a pattern or a picture.

It is another object of the present invention to provide such an apparatus in which each disk has an offset engaging and orienting structure permitting a change in the disk color by brushing a directing object surface over and against the disk so that the directing object surface drags the offset engaging and orienting structure around to the direction of directing object movement and thereby rotates the disk so that a selected color is transmitted through the disk and illuminates the disk with the selected color.

It is still another object of the present invention to provide such an apparatus in which the translucent members are rotatably mounted in ports in an image display board and the board can be positioned substantially vertically without loss of selected disk orientation and of the resulting color selection and collective image, because the disks are engaged by the board and rotate rather than tilt for color selection, permitting the board to be held in front of an existing external light source such as a house lamp or the sun, and the disks to be illuminated by the external light source.

It is finally an object of the present invention to provide such an apparatus which is compact, light weight, easy to use and inexpensive to manufacture.

SUMMARY OF THE INVENTION

The present invention accomplishes the above-stated objectives, as well as others, as may be determined by a fair reading and interpretation of the entire specification.

An image generating apparatus is provided, including a member retaining structure having a retaining structure proximal face and a retaining structure distal face and having several member mounting structures extending between the retaining structure proximal face and the retaining structure distal face, for positioning proximally of a light source so that the light source directs light against the retaining structure distal face; a translucent pigment sheet positioned between the retaining structure distal face and the light source and including several translucent pigment areas; several translucent members, each translucent member being rotatably fitted into one of several the member mounting structures, the translucent members each having a member rotational axis and having a member proximal end and a member distal end; each member distal end including a rotationally a selective color admission structure with a light admitting area radially offset from the member rotational axis to be directly proximal of only a certain limited portion of the translucent pigment sheet, the certain limited portion of the translucent pigment sheet being selected by rotation of the given the translucent member to a particular rotational position relative to the member retaining structure, the certain limited portion of the translucent pigment sheet including at least one translucent pigment area, so that light from the light source passes through the at least one translucent pigment area to illuminate the given translucent member with at least one selected color corresponding to the at least one translucent pigment area; each member proximal end including an offset engaging and orienting structure radially offset from the member rotational axis for engagement by a directing object surface, so that dragging a directing object surface in a selected direction over and against at least one member proximal end causes the directing object surface to engage and move the offset engaging and orienting structure of the at least one member proximal end and thereby to rotate the given translucent member to a position at which the selective color admission structure of the given translucent member is directly proximal of the certain limited portion of the translucent pigment sheet.

The member retaining structure preferably includes an image display board having a board proximal face and a board distal face and having several member mounting structures in the form of member ports extending between the board proximal face and the board distal face. The pigment areas preferably are grouped to form several pigment clusters on the translucent pigment sheet, each pigment cluster being directly distal to one of the translucent members.

An image generating board apparatus is further provided, including an image display board having a board proximal face and a board distal face and having several member ports extending between the board proximal face and the board distal face; a light source positioned distally of the image display board to direct light against the board distal face; a translucent pigment sheet positioned between the board distal face and the light source, the translucent pigment sheet including several pigment clusters, each pigment cluster including several translucent pigment areas; several substantially colorless translucent members, each translucent member being rotatably fitted into one of several member ports, the translucent members each having a member rotational axis and having a member proximal end and a member distal end; each member distal end including a rotationally selective color admission structure including a distal end opaque region and including a distal end translucent region radially offset from the member rotational axis and sized relative to the corresponding pigment cluster to be directly proximal of and to admit light from the light source into the given translucent member from only a certain limited portion of the corresponding the pigment cluster, the certain limited portion including at least one translucent pigment area and being selected by rotation of the given translucent member to a particular rotational position relative to the pigment sheet, so that light from the light source passes through the at least one translucent pigment area to illuminate the given translucent member with at least one selected color corresponding to the at least one translucent pigment area; each member proximal end including an offset engaging and orienting structure radially offset from the member rotational axis for engagement by a directing object surface, so that dragging a directing object surface in a selected direction over and against at least one member proximal end causes the directing object surface to engage and move the offset engaging and orienting structure of the at least one member proximal end and thereby to rotate the given translucent member to a position at which the selective color admission structure of the given translucent member is directly proximal of the certain limited portion of the given pigment cluster.

The pigment sheet preferably is a film sheet and has printed on it the pigment clusters, each pigment cluster being distally adjacent to one of the member distal ends. Each pigment cluster preferably has a pigment cluster center point substantially along the member rotational axis of the corresponding the translucent member and the translucent color pigments are separated from each other substantially along radial lines extending from the pigment cluster center point. The pigment clusters preferably have pigment areas including pigments substantially matching pigments in other pigment clusters and substantially matching the locations of the given pigments in other pigment clusters. Each member distal end is substantially planar. The pigment areas may be radially divided from each other along distinct radial divisions, or blurred together along radial divisions, or may be segments of a continuous pigment gradient extending over the given pigment cluster.

The apparatus preferably additionally includes an apparatus housing containing the light source and the pigment sheet, where the display board forms a forward wall of the apparatus housing. The light source preferably is an incandescent bulb. The apparatus preferably additionally includes a power source, where the apparatus housing contains the power source and contains an electric circuit for delivering power from the power source to the light source. The apparatus preferably additionally includes a battery clip structure within the apparatus housing, and the power source preferably includes at least one D battery replaceably mounted in the battery clip structure. The apparatus preferably additionally includes a battery access door in the apparatus housing for accessing the at least one D battery. The electric circuit preferably includes a switch having a switch actuation lever protruding through a switch opening in the apparatus housing for controlling the flow of electric current to the light source. The apparatus preferably still additionally includes a funnel-shaped reflector having a narrow end and a wide end, the reflector opening at the narrow end around the light source and expanding toward the display board, so that the wide end surrounds the translucent member distal ends. The translucent members preferably are each cylindrically shaped and are each formed of translucent plastic, and the translucent members preferably each have a translucent member distal end which is wider than the translucent member proximal end, so that a step is defined between the translucent member distal end and the translucent member proximal end for abutting the board surrounding the member port. The at least one translucent member preferably is a rod.

The member distal ends preferably each include surface variations for spreading light from the light source across the member distal end. The translucent section of each translucent member preferably has a curved surface for spreading light from the light source more uniformly through each translucent member.

A method of constructing an illuminated image using the above described image generating board apparatus, the method including the steps of rotating certain translucent members by dragging a surface of a directing object over and against the member proximal ends of the certain translucent members so that the directing object surface rubs against the offset engaging and orienting structures of the member proximal ends of the certain translucent members and drags the certain translucent members rotationally around their member rotational axes in the direction of the motion of the directing object until the offset engaging and orienting structures of the certain translucent members are oriented about their rotational paths in the direction of the motion of the directing object and the certain translucent members are illuminated with a selected color so that the certain translucent members are collectively illuminated with colors forming at least a part of a desired image.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
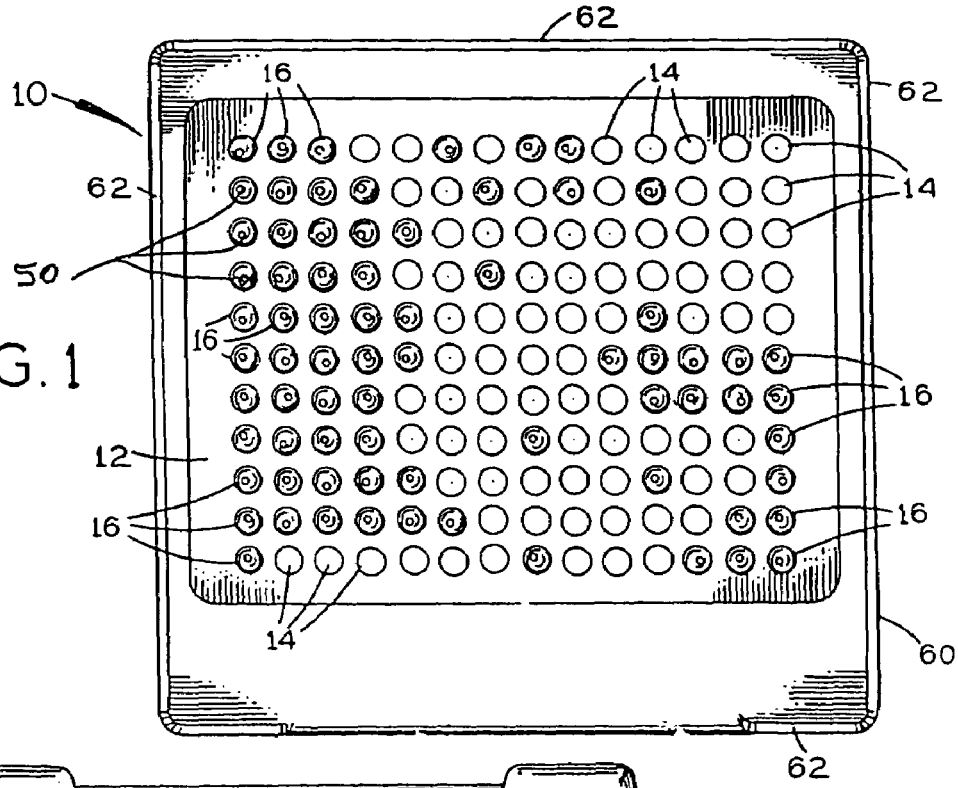
FIG. 1 is a perspective top view of the preferred embodiment of the image creating apparatus.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 9:
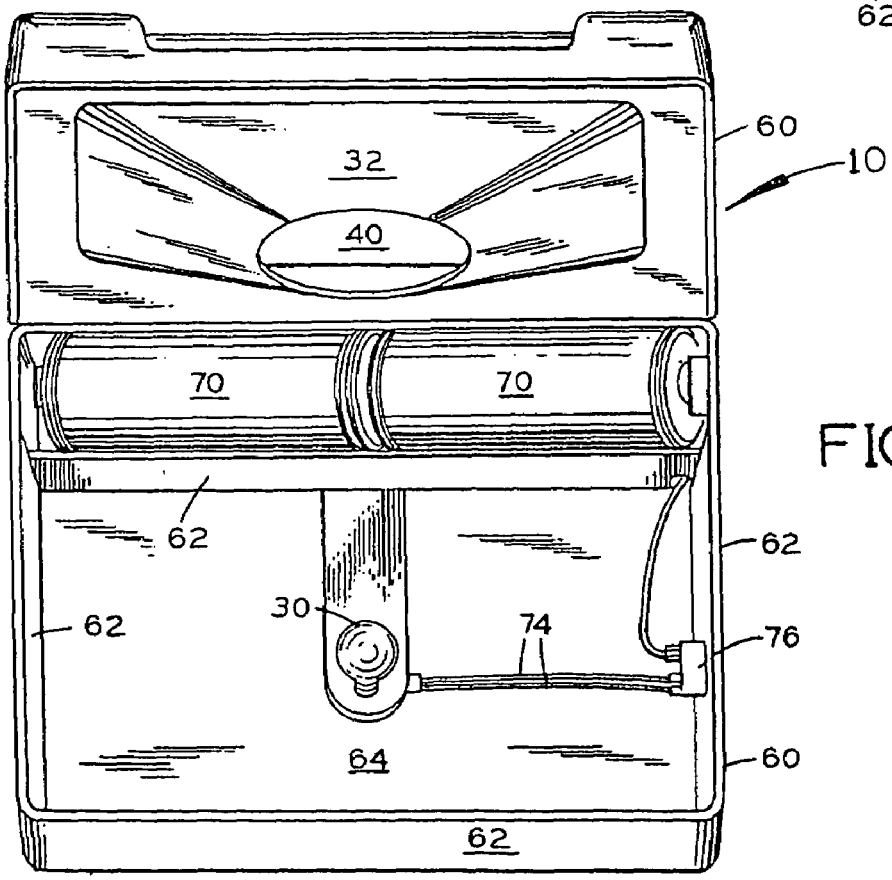
FIG. 9 is a perspective view of the apparatus of FIG. 1 with the housing opened to reveal the light source, power source and battery circuit, as well as the reflector.
Figure 2:
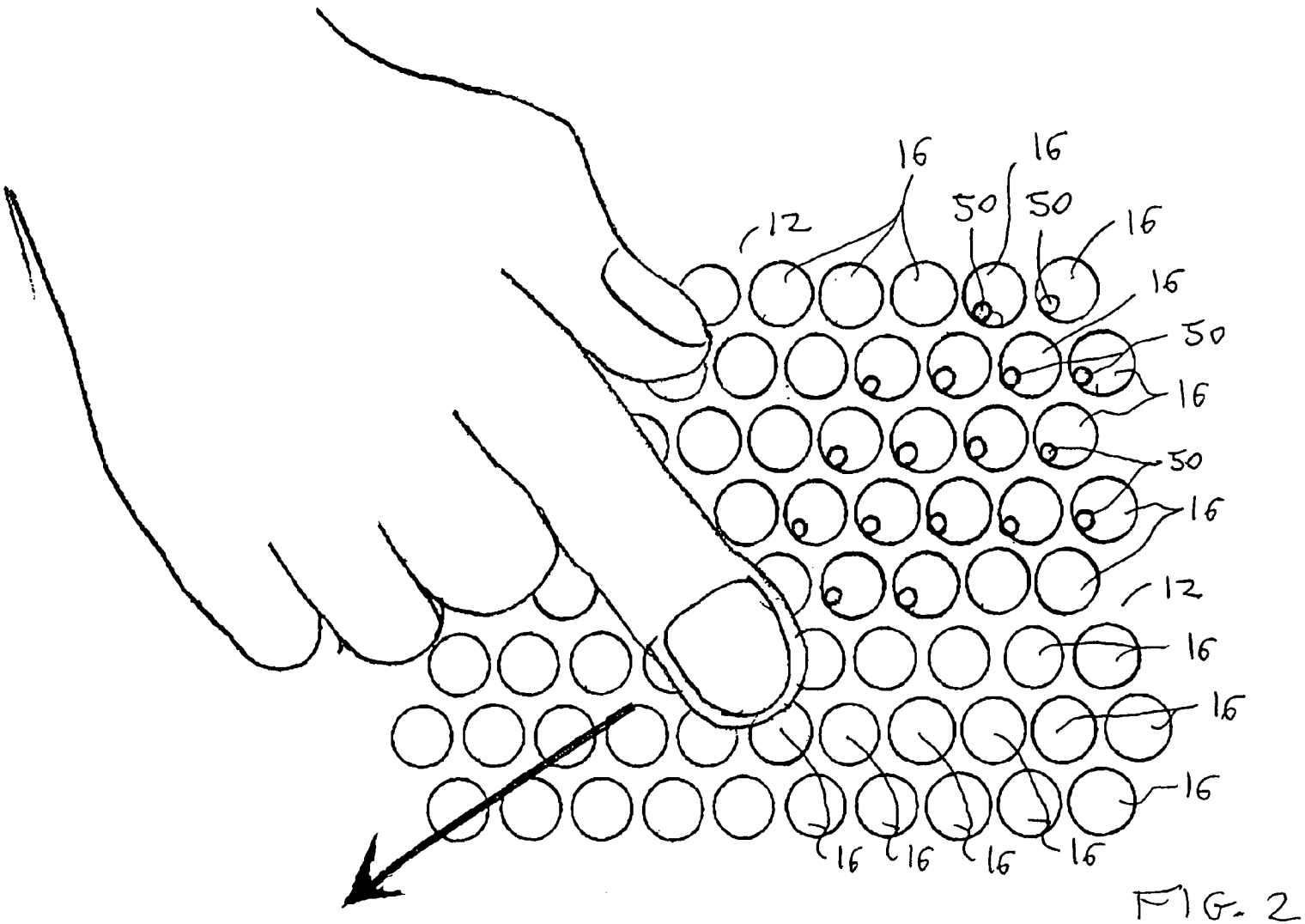
FIG. 2 is a partial top view of the image display board and a number of the disks, showing a directing object in the form of a human finger rubbing over a selected group of the disks and thereby orienting the offset engaging and orienting structures of the disks in the group in the direction of finger movement, so that the disks in the group are all illuminated with the same color.
Figure 4:
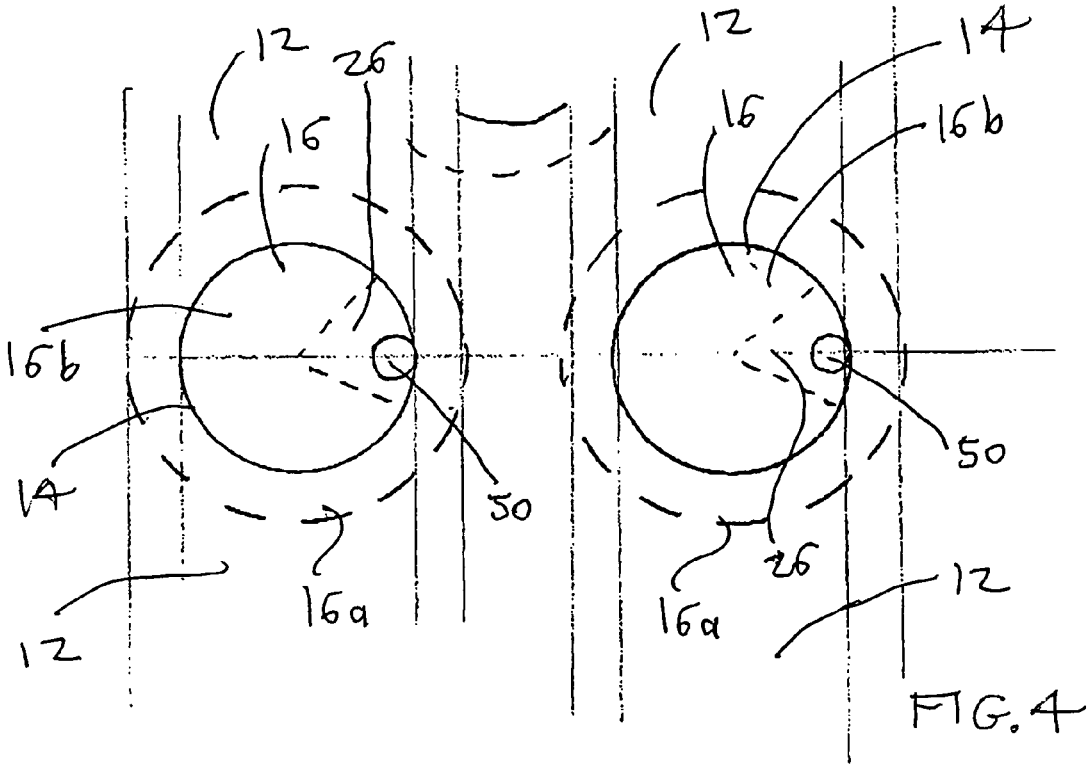
FIG. 4 is a close-up partial top view of the image display board showing two of the translucent member disks, the expanded disk distal ends in broken lines, and the preferred, proximally protruding offset engaging and orienting structures.
Figure 3:
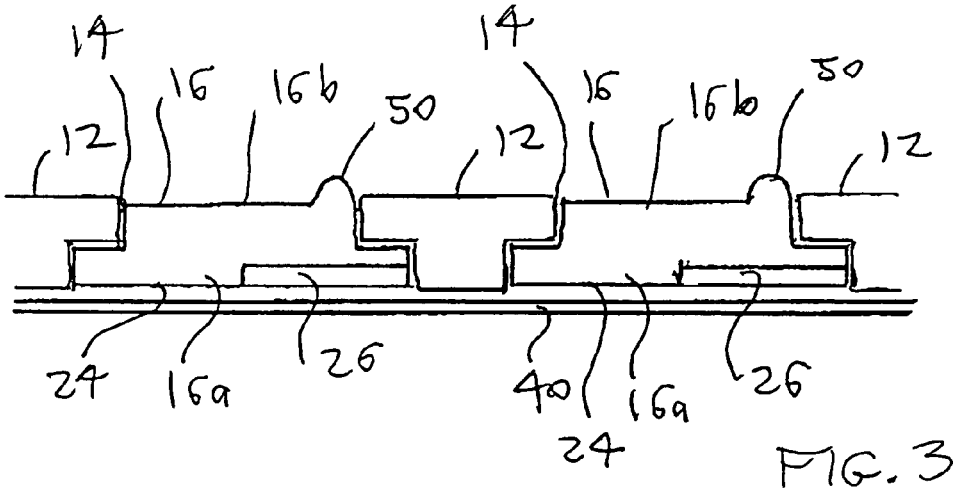
FIG. 3 is a cross-sectional side view of a portion of the image display board showing the translucent members in the form of disks mounted in member ports and having radially expanded disk distal ends and recessed translucent sections of the disk distal ends for selectively admitting light passing through the corresponding pigment clusters, and a cross-sectional side view of a corresponding portion of the translucent pigment sheet mounted distally of and retaining the disks in the member ports.
Figure 5:
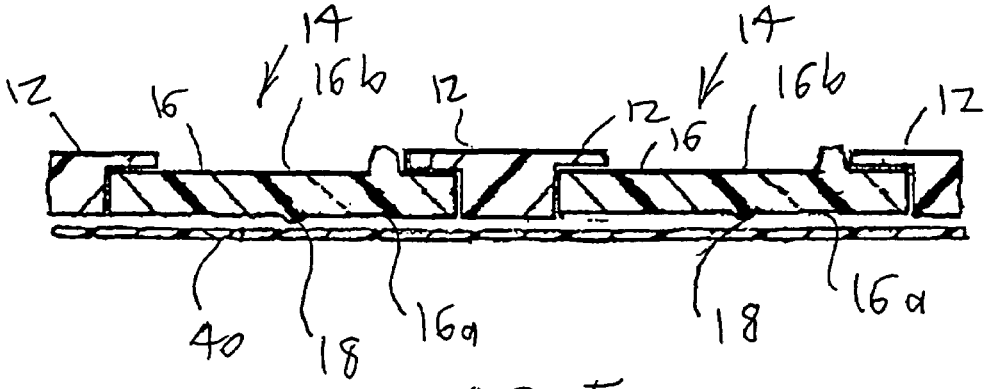
FIG. 5 is a view as in FIG. 3, omitting the member translucent sections and adding the optional friction minimizing bearing protrusions on the member distal ends.
Figure 10:
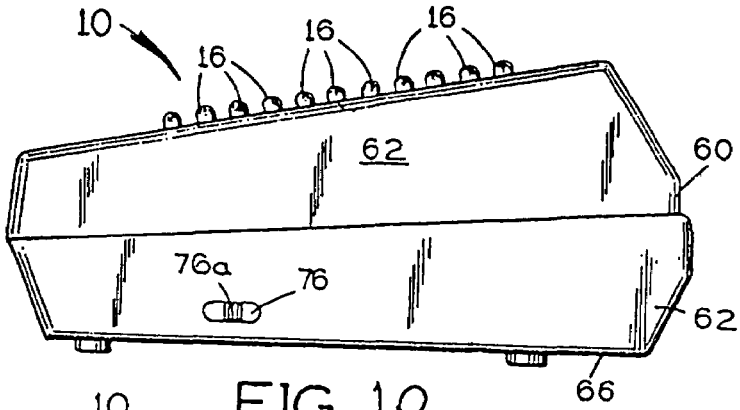
FIG. 10 is a side view of the apparatus housing, showing the switch actuating lever and opening the housing.
Figure 11:
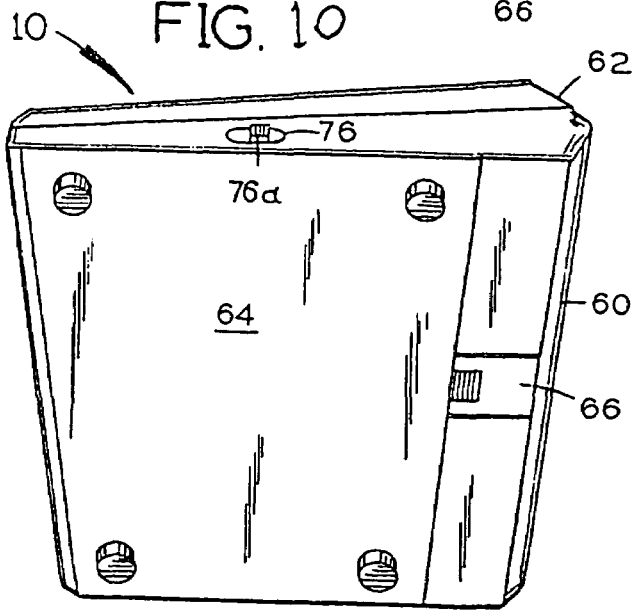
FIG. 11 is a bottom perspective view of the apparatus housing of FIG. 10.
Figure 8:
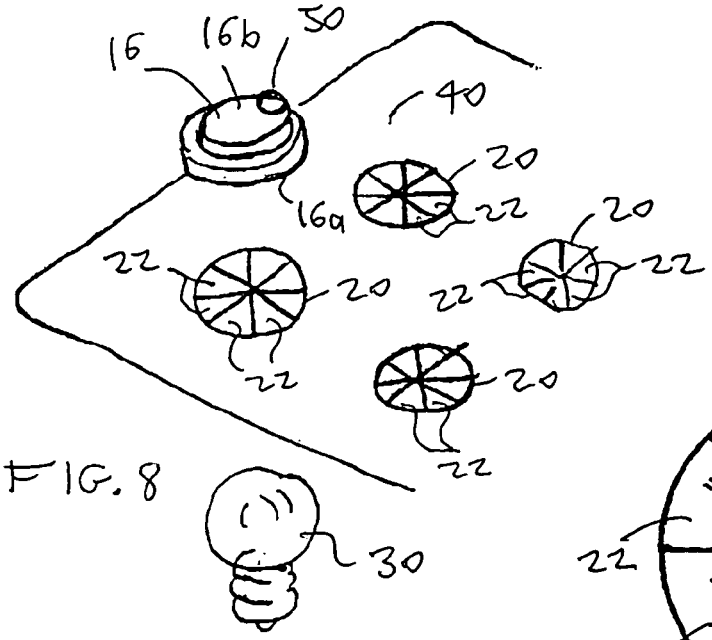
FIG. 8 is a perspective broken away view of the translucent pigment sheet, four of the pigment clusters, a translucent member positioned above and aligned with one of the pigment clusters, and a schematically illustrated light source below the pigment sheet.
Figure 7:
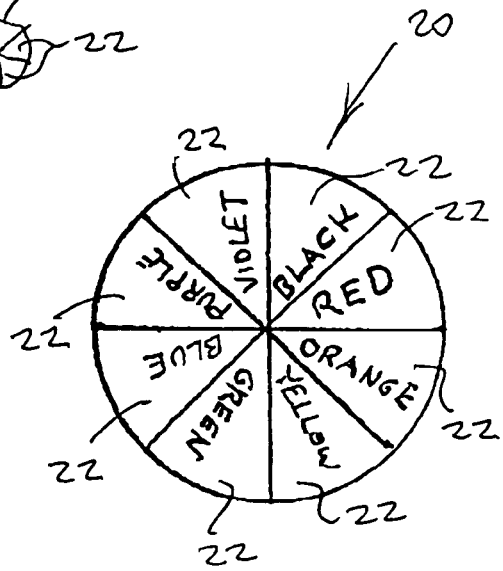
FIG. 7 is a proximal plan view of a pigment cluster marked with example color pigments.
Figure 6:
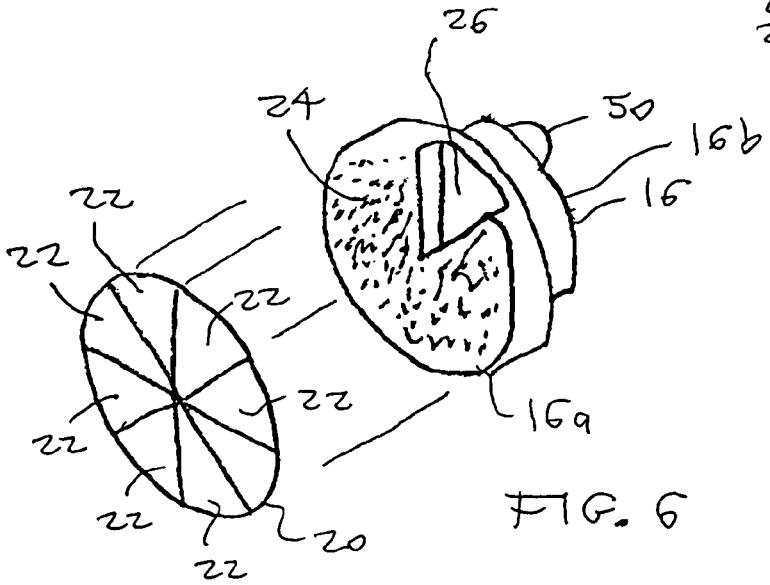
FIG. 6 is an exploded perspective view of a translucent member spaced from and aligned with a pigment cluster, showing the member translucent section and opaque shielding material on the member distal end, and also showing the member offset engaging and orienting structure.
Figures 12, 13, 14:
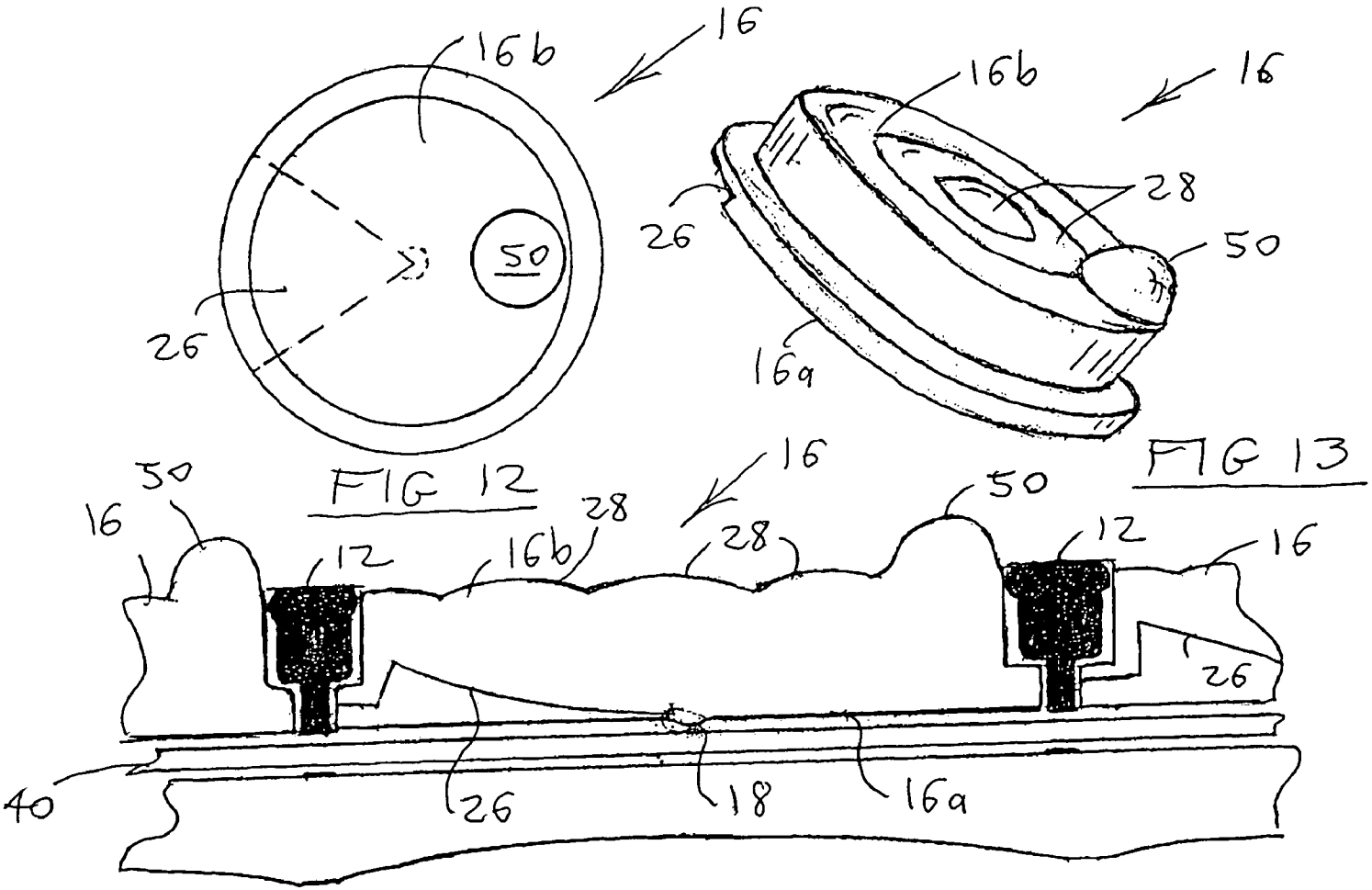
FIG. 12 is a top view of a preferred embodiment of a translucent member having the proximally protruding engaging and orienting structure and a member translucent section offset one hundred eighty degrees from the engaging and orienting structure.
FIG. 13 is a perspective view of the translucent member of FIG. 12, additionally having the light spreading member distal end surface variations, in this particular instance in the form of concentric annular convex bulges, although other configurations of the member distal end surface variations are contemplated.
FIG. 14 is a cross-sectional side view of a portion of the display board and of one of the translucent members, showing the preferred light dispersing curvature of the recessed member translucent section, the bearing protrusion, and the member distal end surface variations.

Referring to FIGS. 1–14, an image generating apparatus 10 is disclosed including an image display board 12 having a board distal face 12*a* and a board proximal face 12*b* and having a grid of member ports 14, each member port 14 being rotatably fitted with a translucent member 16, preferably colorless and preferably taking the form equivalently of a shallow cylinder such as a disk or a deeper cylinder such as a rod or peg, and having a member distal end 16*a* and having a member proximal end 16*b*. A light source 30 is either provided as part of apparatus 10, or an existing light source must be provided by the user, distally of board 12. See FIGS. 8 and 9. A translucent pigment sheet 40 extends between light source 30 and member distal ends 16*a* and preferably takes the form of color film and has pigment clusters 20 positioned directly between light source 30 and each of the member distal ends 16*a*. Each pigment cluster 20 preferably is circular and preferably includes an array of equally sized color pigments separated from each other by either sharp or blurred radial divisions similar to pie cuts, forming translucent pigment areas 22. See FIGS. 6–8. The pigment clusters 20 preferably are identical, having pigment areas 22 of the same colors oriented in the same directions relative to the centers of the pigment clusters 20. Alternatively the pigment areas 22 are oriented in different directions from one pigment cluster 20 to another pigment cluster 20 so that all of the pigment areas 22 extending in a single direction collectively form a pre-set image in the form of a picture or pattern. The diameters of each of the pigment clusters 20 are substantially equal to the diameter of the corresponding member distal end 16*a*. Still alternatively, pigment areas 22 may be segments of a continuous pigment gradient extending over the given pigment cluster 20, so that movement of the translucent section 26 of the corresponding translucent member 16 over the pigment cluster 20 produces a progressive shift in the wavelength or wavelengths of light admitted into the translucent member 16 and a resultant gradual and progressive shift in the color in which the translucent member 16 is illuminated.

Each member distal end 16*a* is covered with an opaque shielding material 24 such as a suitable paint, except for a radially offset translucent section 26 which preferably extends between two radial divisions in a cut-pie slice shape, and preferably is of a size equal to that of each radially contained pigment area 22 of the corresponding pigment cluster 20, through which light passing through and filtered by the selected pigment area or areas 22 is transmitted into the member 16, illuminating the member proximal end 16*b* in a selected color or colors. As a result, each member 16 is capable of receiving and displaying one or more colors at a time, multiple colors being blended together when translucent section 26 overlaps two or more pigment areas 22. Translucent section 26 preferably is recessed so that the opaque shielding material 24 may be deposited by contact with a paint covered applicator surface onto the member distal end 16*a*, exclusive of the translucent section 26, during member 16 manufacture. See FIGS. 3 and 6.

Each member 16 has a member rotational axis extending between the member distal end 16*a* and the member proximal end 16*b*. A fiber optic filament (not shown) optionally extends parallel to and laterally spaced from the member 16 rotational axis to open into the translucent section 26 where light is gathered, to help gather and disperse selected wavelengths within the given member 16.

Light shining through the pigment area or areas 22 of each pigment cluster 20 selected by member 16 rotation is isolated and its wavelength of visible light passes into the corresponding member 16. As a result of this construction, a desired color or desired combinations of colors from adjacent pigment areas 22 may be selected simply by stopping member 16 rotation the moment the color appears in the member proximal end 16*b*. By selecting different colors for the various members 16 on display board 12, an illuminated color pattern or a picture image may be created.

Members 16 preferably are mounted close together to form an image with good resolution, and thus they can be difficult to grip with player finger tips. Therefore, to rotate members 16 to produce color changes, an inventive member offset engaging and orienting structure 50 is provided which is radially offset from the member 16 rotational axis. Engaging and orienting structure 50 preferably is a radially offset and proximally extending prong or ridge, or may be a radially offset rough area on the member proximal end 16*b*, creating higher friction engagement than the remaining area of the member proximal end 16*b* when rubbed. The user of apparatus 10 orients members 16 by sweeping the surface of a directing object such as the palm of a user hand or the bristles of a brush over the member proximal ends 16*b* so that the surface rubs against the engaging and orienting structures 50 and drags the members 16 rotationally around their rotational axes in the direction of the motion of the directing object until the offset engaging and orienting structures 50 of the rubbed members 16 are fully oriented about their rotational paths in the direction of directing object motion. In this way members 16 in different selected regions of the board 12 are uniformly oriented to position translucent sections 26 directly proximal of matching pigment areas 22 of their pigment clusters 20 to display the same color or colors and to create parts of desired pictures or patterns. See FIG. 1.

It is preferred members 16 be manufactured such that offset engaging and orienting structure 50 is 180 degrees offset from, and thus is diametrically opposed in position to, translucent section 26, particularly where members 16 have minimal depth, such as when members 16 are disks rather than pegs. See FIGS. 12–14. In this way structure 50 is not directly proximal of translucent section 26 and does not concentrate light passing through members 12. It is also preferred that the portion of member distal end 16*a* contained within translucent section 26 be concave, convex or otherwise suitably non-planar so that light entering translucent section 26 spreads out more uniformly through the member 16. The curvature of translucent section 26 preferably is of progressive magnitude. See FIGS. 13 and 14. It is also preferred that convex or concave member distal end surface variations 28 which optionally take the form of concentric ring protrusions or recesses be formed into each member proximal end 16*b* to help refract, diffuse and spread light entering member distal end 16*a* across the member proximal end 16*b*.

Display board 12 preferably is the forward wall of an apparatus housing 60 containing light source 30 and translucent pigment sheet 40. Housing 60 preferably includes side walls 62 and a rear wall 64, and display board 12 is secured to and between housing side walls 62. See FIGS. 9, 10 and 11.

Members 16 are each preferably cylindrical and formed of Lucite plastic, and have a distal end 16*a* expanded radially to form a step for rotatably abutting display board 12 surfaces surrounding the member port 14 into which members 16 are snugly but rotatably fitted. Expanded distal ends 16*a* each preferably fit into a member port radially expanded segment concentrically surrounding each member port 14 and extending rearwardly from display board 12. See FIG. 3. Member distal ends 16*a* preferably rest rotatably against and are retained within member ports 14 by pigment sheet 40. To minimize member 16 friction against pigment sheet 40 during member 16 rotation, a bearing protrusion 18 optionally protrudes from member distal ends 16*a* along the member axis of rotation.

Light source 30 is preferably a conventional incandescent bulb of low wattage. Light source 30 alternatively may be fluorescent lighting or light emitting diodes, or any other suitable light generating means. Still alternatively light source 30 may be any light source delivering light of sufficient intensity to the member distal ends 16*a*, such as a home lamp or the sun. In the detailed description and claims of this patent application a light source 30 is a light generating device or structure such as a light bulb positioned distal to the pigment sheet 40, or equivalently a light source 30 is a light reflecting surface such as a mirror positioned distal to the pigment sheet 40 which reflects light from a light generating device or structure positioned distal to, proximal to or lateral to the pigment sheet 40. And whether the light source 30 is a light generating device or a light reflecting surface, light source 30 is understood to be equivalently either directly distal to the pigment sheet 40 or distal to and laterally offset from the pigment sheet 40, and equivalently is positioned either parallel to or at an angle relative to pigment sheet 40. Since members 16 rotate rather than tilt for color selection, board 12 may be oriented substantially vertically without loss of selected member 16 orientation and thus board 12 can be placed conveniently between an external light source and the user and, if the external light source delivers light of sufficient intensity through pigment sheet 40 and into member distal ends 16*a*, the selected collective color pattern or picture formed by members 16 is illuminated and thus made visible.

Housing 60 preferably contains a power source 70 such as and preferably in the form of several D batteries replaceably mounted in a conventional battery clip structure 72, and contains an electric circuit 74 for delivering power from power source 70 to light source 30. See FIG. 9. It is understood that power source 70 may take many other forms, including a 1½ volt battery of any size and could use 120 AC household electrical power or converters. A battery access door 66 preferably is provided in the housing rear wall 64 or side wall 62 for periodically accessing and replacing spent batteries. Power circuit 74 includes a switch 76 having a switch actuation lever 76*a* protruding through a switch opening in the housing 60 for controlling the flow of current to light source 30. Housing 60 preferably also contains a funnel-shaped reflector 32 opening at its narrow end around light source 30 and expanding toward the pigment sheet 40, directing light to all of the member distal ends 16*a*. Reflector 32 may be made of foil, of vacuum-formed plastic with a mirror vapor deposition surface, or of any other suitable material.

It is to be understood that for this or any other display board 12 embodiments described in this application, the pattern of members 16 may be in a square grid, as illustrated in FIG. 1, or may take any other desired arrangement. One arrangement specifically contemplated is staggered member 16 lines, which places the members 16 closer together. See FIG. 2. A lens-shaped, convex protrusion (not shown)

optionally is molded into the pigment sheet 40 below each member 16 to better capture and direct light from light source 30 into the member 16.

METHOD

In practicing the invention, the following method may be used. The player rotates a group of given members 16 by sliding or brushing a surface of a directing object over the member proximal ends 16*b* so that the directing object surface rubs against the offset engaging and orienting structures 50 and drags the given members 16 rotationally around their rotational axes in the direction of the directing object motion until the offset engaging and orienting structures 50 of the given members 16 are fully oriented about their rotational paths in the direction of the directing object motion, such that the translucent sections 26 of the given members 16 are positioned proximally of selected pigment areas 22 and only light from the light source passing through the selected pigment areas 22 enters the given members 16, and members 16 are illuminated with a selected color or colors and the illuminated color or colors of each of members 16 collectively form a desired image in the form of a pattern or picture.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An image generating apparatus, comprising:

a member retaining means having a retaining means proximal face and a retaining means distal face and having a plurality of member mounting structures extending between said retaining means proximal face and said retaining means distal face, for positioning proximally of a light source such that the light source directs light against said retaining means distal face;

a translucent pigment sheet positioned between said retaining means distal face and the light source and including a plurality of translucent pigment areas;

a plurality of translucent members, each said translucent member being rotatably fitted into one of a plurality of said member mounting structures, said translucent members each having a member rotational axis and having a member proximal end and a member distal end positioned adjacent to a certain limited portion of said pigment sheet, each said certain limited portion comprising at least one of said translucent pigment areas;

each said member distal end of each given translucent member comprising a rotationally selective color admission means with a light admitting area radially offset from the member rotational axis to be rotatable to a position aligned with a given said translucent pigment area and rotatable out of alignment with the given said translucent pigment area directly proximal of only a certain limited portion of said translucent pigment sheet, a given translucent pigment area is thus selected by rotation of the said translucent member to a particular rotational position relative to said member retaining means;

such that light from the light source passes through the at least one said translucent pigment area to illuminate the given said translucent member with at least one selected color corresponding to the at least one said translucent pigment area;

each said member proximal end comprising an offset engaging and orienting structure radially offset from the member rotational axis for engagement by a directing object surface, such that dragging a directing object surface in a selected direction over and against at least one said member proximal end causes the directing object surface to engage and move the offset engaging and orienting structure of the at least one said member proximal end and thereby to rotate the given translucent member to a position at which the selective color admission means of the given translucent member is directly proximal of the certain limited portion of said translucent pigment sheet.

2. An apparatus according to claim 1, wherein said member retaining means comprises an image display board having a board proximal face and a board distal face and having a plurality of member mounting structures in the form of member ports extending between said board proximal face and said board distal face.

3. An apparatus according to claim 1, wherein said translucent pigment areas are grouped to form a plurality of pigment clusters on said translucent pigment sheet, each said pigment cluster being directly proximal to one of said translucent members.

4. An image generating board apparatus, comprising:

an image display board having a board proximal face and a board distal face and having a plurality of member ports extending between said board proximal face and said board distal face, for positioning proximally of a light source such that the light source directs light against said board distal face;

a translucent pigment sheet positioned between said board distal face and the light source, said translucent pigment sheet including a plurality of pigment clusters, each said pigment cluster including a plurality of translucent pigment areas;

a plurality of substantially colorless translucent members, each said translucent member being rotatably fitted into one of at least two said member ports, said translucent members each having a member rotational axis and having a member proximal end and a member distal end positioned adjacent to a certain limited portion of said pigment sheet, each said certain limited portion comprising at least one of said translucent pigment areas;

each said member distal end of each given said translucent member comprising a rotationally selective color admission means with a light admitting area radially offset from the member rotational axis to be directly proximal of only a certain limited portion of the corresponding said pigment cluster, a given said translucent pigment area is thus selected by rotation of the given said distal end member to a particular rotational position relative to said image display board, such that light from the light source passes through the at least one said translucent pigment area to illuminate the given said translucent member with at least one selected color corresponding to the at least one said translucent pigment area;

each said member proximal end comprising an offset engaging and orienting structure radially offset from the member rotational axis for engagement by a directing object surface, such that dragging a directing object surface in a selected direction over and against at least one said member proximal end causes the directing object surface to engage and move the offset engaging and orienting structure of the at least one said member proximal end and thereby to rotate the given translucent member to a position at which the selective color admission means of the given translucent member is directly proximal of said certain limited portion of the given said pigment cluster.

5. An apparatus according to claim 4, wherein said pigment clusters have pigment areas comprising pigments substantially matching pigments in other said pigment clusters and substantially matching pigments the locations of the given pigments in other said pigment clusters.

6. An image generating board apparatus, comprising:

an image display board having a board proximal face and a board distal face and having a plurality of member ports extending between said board proximal face and said board distal face;

a light source positioned distally of said image display board to direct light against said board distal face;

a translucent pigment sheet positioned between said board distal face and said light source, said translucent pigment sheet including a plurality of pigment clusters, each said pigment cluster including a plurality of translucent pigment areas;

a plurality of substantially colorless translucent members, each said translucent member being rotatably fitted into one of a plurality of said member ports, said translucent members each having a member rotational axis and having a member proximal end and a member distal end positioned adjacent to a certain limited portion of said pigment sheet, each said certain limited portion comprising at least one of said translucent pigment areas;

each said member distal end of each given said translucent member comprising a rotationally selective color admission means with a light admitting area radially offset from the member rotational axis to be rotatable to a position aligned with a given said translucent pigment area and rotatable out of alignment with the given said translucent pigment area of the given said pigment cluster corresponding to the given translucent member, a given said translucent pigment area is thus selected by rotation of the given said translucent member to a particular rotational position relative to said image display board, such that light from said light source passes through the at least one said translucent pigment area to illuminate the given said translucent member with at least one selected color corresponding to the at least one said translucent pigment area;

each said member proximal end comprising an offset engaging and orienting structure radially offset from the member rotational axis for engagement by a directing object surface, such that dragging a directing object surface in a selected direction over and against at least one said member proximal end causes the directing object surface to engage and move the offset engaging and orienting structure of the at least one said member proximal end and thereby to rotate the given translucent member to a position at which the selective color admission means of the given translucent member is directly proximal of said certain limited portion of the given said pigment cluster.

7. An apparatus according to claim 4, wherein said pigment clusters have pigment areas comprising pigments substantially matching pigments in other said pigment clusters and substantially matching the locations of the given pigments in other said pigment clusters.

8. An image generating board apparatus, comprising:

an image display board having a board proximal face and a board distal face and having a plurality of member ports extending between said board proximal face and said board distal face;

a light source positioned distally of said image display board to direct light against said board distal face;

a translucent pigment sheet positioned between said board distal face and said light source, said translucent pigment sheet including a plurality of pigment clusters, each said pigment cluster including a plurality of translucent pigment areas;

a plurality of substantially colorless translucent members, each said translucent member being rotatably fitted into one of a plurality of said member ports, said translucent members each having a member rotational axis and having a member proximal end and a member distal end positioned adjacent to a certain limited portion of said pigment sheet, each said certain limited portion comprising at least one of said translucent pigment areas;

each said member distal end of each given said translucent member comprising a rotationally selective color admission means including a distal end opaque region and including a distal end translucent region radially offset from the member rotational axis and sized relative to the corresponding said pigment cluster to be directly proximal of and to admit light from said light source into the given translucent member from only a certain limited portion of the corresponding said pigment cluster, a given said translucent area is thus selected by rotation of the given translucent member to a particular rotational position relative to said pigment sheet, such that light from said light source passes through the at least one said translucent pigment area to illuminate the given said translucent member with at least one selected color corresponding to the at least one said translucent pigment area;

each said member proximal end comprising an offset engaging and orienting structure radially offset from the member rotational axis for engagement by a directing object surface, such that dragging a directing object surface in a selected direction over and against at least one said member proximal end causes the directing object surface to engage and move the offset engaging and orienting structure of the at least one said member proximal end and thereby to rotate the given said translucent member to a position at which the selective color admission means of the given translucent member is directly proximal of said certain limited portion of the given said pigment cluster.

9. An apparatus according to claim 8, wherein said pigment sheet is a film sheet and has printed on it said pigment clusters, each said pigment cluster being distally adjacent to one of said member distal ends.

10. An apparatus according to claim 8, wherein each said pigment cluster has a pigment cluster center point substantially along the member rotational axis of the corresponding said translucent member and wherein said translucent color pigments are separated from each other substantially along radial lines extending from the pigment cluster center point.

11. An apparatus according to claim 8, wherein said pigment clusters have pigment areas comprising pigments substantially matching pigments in other said pigment clusters and substantially matching the locations of the given pigments in other said pigment clusters.

12. An apparatus according to claim 8, wherein each said member distal end is substantially planar.

13. An apparatus according to claim 8, additionally comprising an apparatus housing containing said light source and said pigment sheet, wherein said display board forms a forward wall of said apparatus housing.

14. An apparatus according to claim 8, wherein said light source is an incandescent bulb.

15. An apparatus according to claim 13, additionally comprising a power source, wherein said apparatus housing contains said power source and contains an electric circuit for delivering power from said power source to said light source.

16. An apparatus according to claim 15, additionally comprising a battery clip structure within said apparatus housing, wherein said power source comprises at least one D battery replaceably mounted in said battery clip structure.

17. An apparatus according to claim 16, additionally comprising a battery access door in said apparatus housing for accessing said at least one D battery.

18. An apparatus according to claim 15, wherein said electric circuit comprises a switch having a switch actuation lever protruding through a switch opening in said apparatus housing for controlling the flow of electric current to said light source.

19. An apparatus according to claim 8, additionally comprising a funnel-shaped reflector having a narrow end and a wide end, said reflector opening at said narrow end around said light source and expanding toward said display board, such that said wide end surrounds said translucent member distal ends.

20. An apparatus according to claim 8, wherein said translucent members are each cylindrically shaped and are each formed of translucent plastic, and wherein said translucent members each have a translucent member distal end which is wider than said translucent member proximal end, such that a step is defined between said translucent member distal end and said translucent member proximal end for abutting said board surrounding said member port.

21. An apparatus according to claim 20, wherein at least one said translucent member is a peg.

22. An apparatus according to claim 8, additionally comprising member distal end surface variations on each said member distal end for spreading light from said light source across said member distal end.

23. An apparatus according to claim 8 wherein said translucent section of each said translucent member has a curved surface for spreading light from said light source more uniformly through each said translucent member.

24. A method of constructing an illuminated image using an image generating board apparatus comprising an image display board having a board proximal face and a board distal face and having a plurality of member ports extending between said board proximal face and said board distal face, for positioning proximally of a light source such that the light source directs light against said board distal face; a translucent pigment sheet positioned between said board distal face and the light source, said translucent pigment sheet including a plurality of pigment clusters, each said pigment cluster including a plurality of translucent pigment areas; a plurality of substantially colorless translucent members, each said translucent member being rotatably fitted into one of at least two said member ports, said translucent members each having a member rotational axis and having a member proximal end and a member distal end positioned adjacent to a certain limited portion of said pigment sheet, each said certain limited portion comprising at least one of said translucent pigment areas; each said member distal end of each given translucent member comprising a rotationally selective color admission means with a light admitting area radially offset from the member rotational axis to be rotatable to a position aligned with a given said translucent pigment area of the given said pigment cluster corresponding to the given said translucent member, a given said translucent pigment area is thus selected by rotation of the given said translucent member to a particular rotational position relative to said image display board, such that light from the light source passes through the at least one said translucent pigment area to illuminate the given said translucent member with at least one selected color corresponding to the at least one said translucent pigment area; each said member proximal end comprising an offset engaging and orienting structure radially offset from the member rotational axis for engagement by a directing object surface, such that dragging a directing object surface in a selected direction over and against at least one said member proximal end causes the directing object surface to engage and move the offset engaging and orienting structure at the at least one said member proximal end and thereby to rotate the given translucent member to a position at which the selective color admission means of the given translucent member is directly proximal of said certain limited portion of the given said pigment cluster, the method comprising the steps of:

rotating certain translucent members by dragging a surface of a directing object over and against the member proximal ends of the certain translucent members such that the directing object surface rubs against the offset engaging and orienting structures of the member proximal ends of the certain translucent members and drags the certain translucent members rotationally around their member rotational axes in the direction of the motion of the directing object until the offset engaging and orienting structures of the certain translucent members are oriented about their rotational paths in the direction of the motion of the directing object and the certain translucent members are illuminated with a selected color such that the certain translucent members are collectively illuminated with colors forming at least a part of a desired image.

* * * * *